US009608336B1

(12) United States Patent
Fong

(10) Patent No.: US 9,608,336 B1
(45) Date of Patent: Mar. 28, 2017

(54) RADIAL-FREE COLLINEAR OMNI-DIRECTIONAL TRIBAND HALF WAVELENGTH ANTENNA WITH VIRTUAL GROUND, SINGLE COAXIAL CABLE FEEDPOINT, AND WITH MINIMAL INTERACTION OF ADJUSTMENT BETWEEN BANDS

(71) Applicant: Edison Fong, Sunnyvale, CA (US)

(72) Inventor: Edison Fong, Sunnyvale, CA (US)

( * ) Notice: Subject to any disclaimer, the term of this patent is extended or adjusted under 35 U.S.C. 154(b) by 47 days.

(21) Appl. No.: 14/834,435

(22) Filed: Aug. 25, 2015

(51) Int. Cl.
*H01Q 9/04* (2006.01)
*H01Q 21/30* (2006.01)
*H01Q 9/18* (2006.01)
*H01Q 1/36* (2006.01)

(52) U.S. Cl.
CPC ..... *H01Q 21/30* (2013.01); *H01Q 1/362* (2013.01); *H01Q 9/18* (2013.01)

(58) Field of Classification Search
None
See application file for complete search history.

(56) References Cited

U.S. PATENT DOCUMENTS 2,124,424 A * 7/1938 McConnell ..... H01P 5/02 333/26
4,259,673 A * 3/1981 Guretzky ..... H01Q 9/065 343/825
4,675,687 A * 6/1987 Elliott ..... H01Q 5/321 343/715
4,764,773 A * 8/1988 Larsen ..... H01Q 1/1285 333/25
6,191,747 B1 * 2/2001 Cosenza ..... H01Q 1/1285 343/713
9,007,270 B2 * 4/2015 Ngo Bui Hung ..... H01Q 5/00 343/787
2005/0253768 A1 * 11/2005 Bui Hung ..... H01Q 5/00 343/790
2010/0283699 A1 * 11/2010 Apostolos ..... H01Q 1/3275 343/792
2012/0182196 A1 * 7/2012 Ngo Bui Hung ..... H01Q 1/52 343/792
2013/0127676 A1 * 5/2013 Goetz ..... H01Q 21/30 343/715
2014/0111397 A1 * 4/2014 Lim ..... H01Q 1/362 343/826

* cited by examiner

*Primary Examiner* — Trinh Dinh
(74) *Attorney, Agent, or Firm* — Michael A. Kaufman, Esq.

(57) ABSTRACT

An omni-directional triband antenna operates without ground radials with gain commensurate with a half wavelength vertical on each band. The triband antenna includes a dual-band twinlead J-pole providing half wavelength radiators for UHF and VHF, and an impedance transformer defining feedpoints to which a length Lc of coaxial cable is attached. The Lc lower end is the triband antenna connector port. Intermediate band radiators are first and second wire elements that collectively are a half-wavelength at the intermediate band. The first element is wound helically about the impedance transformer, with upper end floating and lower end connected to a first feedpoint. The second element is wound helically about the Lc upper portion of coaxial cable, with upper end connected to the remaining feedpoint, and lower end of the element floating. The helical windings radiate vertically and there is no cross-interference between antenna radiation in any of the three bands.

20 Claims, 12 Drawing Sheets

RADIAL-FREE COLLINEAR OMNI-DIRECTIONAL TRIBAND HALF WAVELENGTH ANTENNA WITH VIRTUAL GROUND, SINGLE COAXIAL CABLE FEEDPOINT, AND WITH MINIMAL INTERACTION OF ADJUSTMENT BETWEEN BANDS

FIELD OF THE INVENTION

The invention relates generally to antennas that radiate and receive radio frequencies (RF) preferably for use in the very high frequency (VHF) range (about 140 MHz-170 MHz), an intermediate range (about 220 MHz-225 MHz), and ultra-high frequency (UHF) range (about 420 MHz-470 MHz), which antennas do not require radials or connection to absolute ground. Preferably such antennas should be mechanically robust over extremes of temperature and wind, and should be relatively inexpensive to mass produce and transport, with a length under about 2 m. Further, such antennas should exhibit gain commensurate with a half wavelength dipole over at least three bands ranging from VHF to UHF, including operation intermediate VHF and UHF frequencies. The antenna should exhibit minimal inter-band interaction if antenna adjustments are made, should have a single coaxial cable feed point, and should be relatively maintenance free.

BACKGROUND OF THE INVENTION

Radio frequency (RF) antennas are used to receive and/or radiate RF signals.

An effective antenna for use in transmission will exhibit an acceptably low standing wave ratio (SWR) at the frequencies of interest, and will present a reasonably good impedance match to the output of the transmitter, typically 50Ω to 75Ω. While some antenna designs such as beams exhibit directionality, i.e., more antenna gain in one direction compared to another, in many applications it is desired that the pattern of radiation from the antenna be omnidirectional. Further it is often desired that the antenna not require ground radials. Ground radials undesirably increase antenna wind load thus lessening robustness and portability, and increase manufacturing cost.

Many innovations in antenna design have come from the amateur radio community. Pioneer work in the area of so-called fractal antenna has been accomplished by Nathan Cohen (W1IR, W1YW) of Belmont, Mass., e.g., U.S. Pat. Nos. 6,104,349, 6,127,977, 6,140,975, 6,445,352, 7,019,695, and 7,701,396, among others.

Another innovation in multi-band antenna design is depicted in FIGS. 1A and 1B, namely the so-called Don Johnson screwdriver antenna, invented in March 1991 and named after its late inventor Don Johnson (W6AAQ) of Esparta, Calif. Overall antenna 10 includes a whip portion 20, typically 3' to perhaps 8' in length, mounted to make electrical connection with the upper end of an inductor 30. Inductor 30 typically is formed about a non-conductive cylinder of perhaps 2" diameter and perhaps 12" length. The upper portion of housing 40 includes conductive finger stock that presses against inductor 30, effectively grounding to housing 40 all portions of inductor 40 that are within the housing. Inductor 30 and the cylinder it is formed upon can be urged vertically upward and downward within a metal cylinder housing 40 to alter magnitude of the effective inductance protruding from housing 40. A threaded rotatable shaft 80 is connected between the lower end of the inductor

30 cylinder and the rotatable shaft of a small DC motor 70. Motor 70 is typically a motor from an electric screwdriver, hence the "screwdriver" name for the antenna. Two wires from motor 70 can be applied to a plus or a minus polarity DC voltage, to cause motor 70 to rotate clockwise or counterclockwise, causing more or less of inductor 30 to lie within housing 40, which is to say to decrease or increase magnitude of the effective inductance protruding from the housing. A matching inductor 50 is formed at the base of the antenna and a length of typically 50Ω coaxial cable 60 is connected as shown. The other end of coaxial cable 60 will typically go to a transceiver, or transmitter, or receiver. Tuning antenna 10 simply involves applying plus or minus DC voltage to motor 70 to mechanically resonate the antenna to a desired frequency range. Antenna 10 can be tuned by first setting the transceiver (or receiver) to a desired frequency and then adjusting the effective length of inductor 30 by rotating motor 70 in the proper direction (by applying plus or minus voltage to motor 70) to resonate the antenna, as evidenced by a peak in amplitude of received signals.

In FIG. 1A, DC voltage has been applied to motor 70 to rotate nearly all of inductor 30 into housing 40. The effect at RF frequencies is that only the portion of inductor 30 protruding from housing 40 functions as an inductor. The antenna operates as a center loaded device whose resonance is determined primarily by the effective inductance 30 and the whip 20. In FIG. 1B, DC voltage was applied to motor 70 to rotate threaded shaft 80 such that more of inductor 30 can now resonant with whip 20 such that the additional effective inductance lowers the resonant frequency of the overall antenna. Advantageously the antenna can operate continuously within a very wide range of frequencies, merely by applying DC voltage to motor 70 to cause more or less inductance to be used. In practice, many thousands of Don Johnson (W6AAQ) screwdriver antennas have been used worldwide with great success over frequencies ranging from as low as about 3.5 MHz to as high as perhaps 144 MHz.

In other applications, especially higher frequency applications, a less mechanical antenna may be desired, especially for considerations of cost and ease of construction. In the radio amateur community, high frequency bands of interest include VHF (2 m range wavelengths, typically about 144 MHz to about 148 MHz), UHF (70 cm range wavelengths, typically about 420 MHz to about 450 MHz), and intermediate to VHF and UHF, the 1.25 m range wavelengths (typically about 222 MHz to about 225 MHz). One common type of antenna, especially for VHF (2 m range wavelengths) and/or UHF (70 cm range wavelengths), is the so-called collinear antenna. A collinear antenna is an array of at least two dipole antennas, configured such that every element of each dipole is an extension, relative to a longitudinal antenna axis, of the other dipoles in the array. Collinear antennas can exhibit gain over an isotropic radiator.

FIG. 2A depicts an antenna 90 comprising collinear elements 100, 110, 120, used with at least four antenna base-mounted quarter-wavelength radials 130 that function as a ground plane. Preferably coaxial cable 60 is coupled to antenna 90, with the other end of coaxial cable 60 coupled to a transceiver, a transmitter, or a receiver (not shown). Lowermost element 100 in FIG. 2A is a quarter-wavelength at the nominal frequency of interest. Intermediate element 110 is coupled to act as a half-wave delay element, and uppermost radiating element 120 preferably has a length equal to a half-wave. The various elements 100, 110, 120 can be fabricated from lengths of coaxial cable, whose center conductor is indicated by phantom lines, and whose outer shield conductor is indicated by solid lines on either side of the center conductor. Note that the collinear arrangement alternates electrical connection between the center conductor of an element and the outer conductor.

In FIG. 2A, if one tried to use quarter-wavelength element 100 with an extension half-wavelength (i.e., center-conductor to center-conductor, shield-to-shield), no additional gain would result due to phase cancellation of radiation in the quarter-wave and half-wave elements. FIG. 2B depicts voltage amplitude versus phase for the various elements of antenna 90. As confirmed by FIG. 2B, non-radiating half-wave delay element 110 provides the desired ground reference function. This results from coupling the shielded outer conductor of element 100 to the inner conductor of element 110, which inner conductor acts as a ground reference. Note at the base of antenna 90 that radials 130 are also coupled to this ground reference via the center conductor of element 100. As shown in FIG. 2A, after a quarter-wavelength at the junction of elements 100 and 110, the shield and inner conductor are swapped. At its upper end, element 110 is coupled to the lower end of half-wave coaxial element 120, again by swapping of center conductor and shield outer conductor. As the radiated radio frequency energy exits the upper end of element 120 it is back in phase with quarter-wavelength radiating element 100. If desired additional elements, i.e., another triplet of elements 100, 120, 120 could be added atop present uppermost element 120 in collinear fashion. However a point of diminishing returns effectively occurs at about four elements in that marginal further increase in gain does not warrant the cost of the additional elements.

Disadvantageously, antenna 90 requires several, typically at least four, quarter-wavelength radials 130, preferably bent downward at an angle of perhaps 45° to establish an RF ground. As noted, an RF ground reference node exists at the junction of radials 130 and the outer shield of coaxial cable 60. Radials often require machining to properly make good electrical connection at the base of antenna 90. In practice stainless steel radials are preferred for reasons of strength and electrical contact over less expensive aluminum radials. The presence of radials impacts the robustness of the antenna design. Radials can easily break off in the presence of strong winds, or by birds perching on the radials. If the radials are on the ground, they may be damaged from being walked upon. Further, the electrical conductivity between the radials and the shield of coaxial cable 60 will inevitably deteriorate over time.

FIG. 3 depicts an attempt in the prior art to eliminate radials by using a quarter-wave sleeve. Referring to FIG. 3, antenna 140 has at its base a quarter-wave element 100, then a half-wave delay element 110, above which is disposed an upper half-wave radiating element 120. These collinear elements 100, 110, 120 in antenna 140 are configured similarly to the same elements in antenna 90 in FIG. 2A, and are made from segments of coaxial cable. Rather than employ radials (as in FIG. 2A), antenna 90 employs a conductive quarter-wavelength sleeve 150 to implement an effective quarter-wavelength foldback and RF ground reference. The term "foldback" is used in that sleeve 150 covers a portion of the connecting coaxial cable 60. Sleeve 150 is commonly made of conductive brass or copper pipe, and the connection to coaxial cable 60 is typically made within the sleeve. This configuration advantageously gains robustness by eliminating radials, and exhibits a slightly lower angle of radiation that can add to transmitting and receiving range of the antenna. However the sleeve configuration can make it difficult to achieve desired low SWR due to inherent coupling between the outer shield conductor of coaxial cable 60 and the wall of sleeve 150.

FIG. 4 depicts yet another attempt in the prior art to implement an omnidirectional antenna without radials. As shown in FIG. 4, a portion of this antenna looks like the letter "J", and this configuration is sometimes referred to as a "Super-J" antenna. A full description of antenna 160 may be found in the ARRL Antenna Handbook, 19$^{th}$ ed., chapter 16, pp. 24-27, "The Supper J Maritime Antenna." Referring to FIG. 4, the lower end of antenna 160 is a quarter wavelength matching element 170, typically 300 twinlead, whose two leads or wires are shorted together at the bottom 180. The RF impedance at the shorted bottom 180 is of course 0Ω, but at a distance Δ above bottom 180, the RF impedance will be close to the impedance of coaxial cable 60 to be a good match, e.g., 50Ω or so. The upper end of quarter-wavelength matching element 170 is coupled to a half-wave radiating element 190, as the upper end of quarter-wavelength matching element 170, and either end of half-wave radiating element 190 are both RF high impedances.

Referring still to FIG. 4, note that elements 190 and 210 are disposed vertically and are RF radiating elements. By contrast, the upper end of half-wave radiating element 190 is coupled to a horizontally disposed delay element 200. Delay element 200 comprises two parallel quarter-wavelength element coupled in a horizontally-disposed "U"-shaped configuration. The horizontally polarized RF energy associated with the lower and with the upper elements of delay element 200 are 90° out-of-phase with respect to each other and thus cancel one another. Ideally the phase delay and radiation patterns associated with element 200 would be perfectly out-of-phase, but in practice some phase error and associated antenna inefficiency will exist. "U"-shaped delay element 200 may be thought of as contributing an outgoing lower quarter-wavelength delay and an incoming quarter-wavelength delay. The net result is that these horizontally disposed elements represent an effective half-wave delay element 200. The upper portion of "U"-shaped delay element 200 is connected to the lower end of a vertically disposed (and vertically radiating) half-wave radiating element 210. In this fashion the antenna of FIG. 4 implements the functional equivalent of the ready access to ground that was present in the antenna of FIG. 2A. The desired overall half-wavelength delay with desired non-radiating characteristics for 180° of the phase waveform is achieved by "U"-shaped element 200.

Regrettably, antenna 160 is not robust in that delay element 200 projects out horizontally from the vertical antenna into the environment, and is difficult to reliably fasten between radiating elements 190 and 210. Alternatively some designs also seek to achieve phase delay with inductor-capacitor (LC) components rather than with an element 200. However such solutions are not optimum because losses and tolerance changes in the L and C components vary over time, which can reduce effectiveness of the desired delay function.

FIG. 5 depicts a so-called conventional mono-band "J-pole" antenna that can be fabricated from a single length of 300Ω twin lead cable, comprising LEAD 1 and LEAD 2, that has a gap or notch cut in one lead (LEAD 1). The lowermost end of antenna 220 has a short 180 between LEAD 1 and LEAD 2 to establish a 0Ω region, adjacent to which is a quarter-wavelength impedance matching element 230, sometimes referred to as a shorting stub element. Impedance matching element 230 is passive in that it does not radiate RF energy. A perhaps 0.25" gap or notch 240 is formed in LEAD 1 to separate element 230 from the remainder of antenna 220. A half-wave RF radiating element 250 is formed above gap 240 in LEAD 1 and above matching element 230 in LEAD 2. The uppermost end of antenna 220 is open ended, or high impedance, and the lowermost end by virtue of the short is 0Ω. Experimentally a pair of low impedance, e.g., 50Ω, feedpoints are found a distance Δ (typically about 1.25") above the 0Ω short 180. Coaxial cable 60 (typically RG174A) center conductor is connected to one feedpoint and the coaxial cable braid shield is connected to the other feedpoint.

Antenna 220 in FIG. 5 may be cut or sized for the 144 MHz VHF band for use within protective 0.75" O.D. 200 PSI PVC pipe, with the detuning effect of the PVC pipe being accounted for in the following dimensions. As such for VHF half wavelength RF radiating element 250 will measure about 37.25", gap 240 will be 0.25", distance Δ will be about 1.25", and quarter wavelength matching element 230 will be about 16". If antenna 220 were cut or sized for the 440 MHz UHF band within the same protective PVC pipe, half wavelength RF radiator 250 would measure about 12", gap 240 will be 0.25", distance Δ will be about 0.5", and quarter wavelength matching element 230 will be about 5", with RG174A coaxial as a preferred cable 60. Of course antenna 220 in FIG. 5 could be scaled to operate in the 220 MHz band, in which case half-wavelength radiating element 250 would be about 26" in length, quarter-wavelength impedance matching element 230 would be about 9.75", the latter 0.75" being the dimension of Δ. These exemplary dimensions assume the finished antenna will be mounted with 0.75" diam. 200 PSI PVC pipe. The term "J-pole" arises from the "J-shape" defined by the LEAD 1 portion of region 230 including the 0Ω short, including Lead 2 extending to the top of the antenna.

Monoband J-pole 220 in FIG. 5 operates as a half wavelength vertical end-fed dipole antenna. In a conventional half-wave antenna, the antenna ends are high impedance and the antenna center including the feedpoints is low impedance. However in the half wavelength J-pole configuration of FIG. 5 the inclusion of the passive quarter wavelength impedance matching section 230 enables end matching to the antenna with an approximately 50Ω feedpoint pair. If antenna 220 is mass produced, it suffices to measure distance Δ on a prototype antenna using an antenna analyzer, and to fine tune location of gap 240, and then to replicate the prototype antenna in quantity. Vertical end-fed monoband J-pole dipole antenna 220 in FIG. 5 has a radiation pattern close to an ideal dipole, thanks to end-fed coaxial cable 60 being in-line with the antenna axis or length. By contrast, in a conventional center-fed vertical dipole, the coaxial cable connects to the center of the antenna at 90° to the axis or length of the antenna, and thus distorts the dipole radiation pattern. A well-designed J-pole antenna 220 is a good half-wave radiator that provides about 2.1 dB gain over an isotropic radiator, but no gain relative to an ideal half-wave antenna.

It will be appreciated that monoband J-pole antenna 220 is omni-directional, inexpensive to fabricate, and requires no radials. In practice the antenna can be inserted within a length of UV-resistant PVC pipe that is sealed at the top and bottom, to provide a robust configuration with relatively low wind resistance. Understandably the dimensions of the J-pole antenna will be adjusted somewhat to compensate for the velocity factor effect of the surrounding PVC pipe upon the antenna characteristics in open air, to avoid detuning. In practice J-pole antenna 220 can achieve about a 1.5 dB gain improvement over a quarter wavelength ground plane antenna because it is a true half wavelength antenna. In a conventional ground plane antenna such as was described in FIG. 2A, ground radials 130 were necessary to act a counter element (e.g., ground or earth). With radials bent downward from say 0° (i.e., horizontal) to about 45°, and disadvantageously a relatively high angle of radiation will result. By contrast, monoband J-pole antenna 220 has no radials and advantageously exhibits a lower angle of radiation, which results in a gain of about 1.5 dB in the horizontal plane relative to a conventional ground plane antenna.

FIG. 6A depicts the DBJ-1 (WB6IQN) dual-band J-pole antenna 260, invented by applicant herein, which resonates and radiates efficiently as a half-wavelength vertical antenna on each of the VHF and UHF bands, using a single feedline, without need for a ground. Referring to FIG. 6A, at the very bottom region 180 of antenna 260 the twinlead (comprising LEAD 1, LEAD 2 with the plastic insulating material not shown) is shorted together to form a 0Ω region. However above this short at a distance Δ (typically about 1.25") a low impedance (preferably about 50Ω) feedpoint pair can be located. Coaxial cable 60, e.g., RG174A, is attached to the antenna at this feedpoint pair and preferably exits antenna 260 collinearly rather than perpendicular to the antenna longitudinal axis or length, to reduce interference with the antenna RF radiation pattern.

Referring still to FIG. 6A, immediately above the low impedance feedpoints antenna is twinlead extending upward a distance l1 (typically about 16"), which together with the small distance Δ (about 1.25") functions as a passive, non-radiating impedance transformer 262. At VHF impedance transformer 262 functions as a quarter wavelength stub matching transformer but at UHF functions as a three-quarter wavelength stub matching transformer, electrically the series sum of a quarter-wavelength and a half-wavelength. As it is non-radiating and passive, impedance transformer 262 does not interfere with UHF RF radiating section 264 or with VHF RF radiating section 268 of antenna 260. A notch or gap 240 of length l2 (about 0.25") is formed in LEAD 1 to separate impedance matching stub region 262 from the remaining regions 264, 266, 268 of the antenna above.

Continuing upward in FIG. 6A, element 264 is the UHF half wavelength radiating portion of antenna 260 and comprises length l3 (about 11.25") of twinlead. As will now be described region 266 functions as a mechanism to decouple the upper end of UHF half wavelength radiator 260 from region 266 and region 268. In theory such UHF decoupling mechanism might be a self-powered SPST relay that sensed when to open (during UHF triband antenna use) and when to close (during non-UHF triband use). In theory such UHF decoupling mechanism might be an ideal inductor in parallel with an ideal capacitor, the inductor-capacitor resonating in the UHF band, i.e., exhibiting infinitely high impedance. But in practice such relays do not exist, and perfect inductors and capacitor (which components have no loss, and do not drift in value) do not exist.

Applicant found a suitable, lightweight and inexpensive UHF decoupling mechanism to be the quarter wavelength stub 266, shown in FIG. 6A. UHF decoupling stub 266 comprises a length l4, a quarter wavelength at UHF (about 4.25"), of preferably RG174A coaxial cable disposed in LEAD 2 to terminate or isolate UHF radiating region 264 from VHF radiating region 268 above at UHF frequencies. At the upper end UHF decoupling stub 266 has its shield and center conductor soldered together to form a zero impedance, which at a UHF quarter wavelength transforms to an open or high impedance at the lower end or bottom of the stub. At the open lower end of stub 266, the center conductor of the coaxial length comprising the stub is soldered to the region of LEAD 2 opposing gap 240, and the braid shield is left floating. At UHF frequencies, UHF decoupling stub 266 presents an open circuit (high impedance) but at VHF frequencies acts as a closed circuit, albeit with small inductance. Above UHF decoupling stub 266 is a length l5 (about 17") of twinlead that coupled with length l4 and length l3 of element 264 comprises the VHF radiating region 268 of antenna 260. It will be appreciated that UHF decoupling stub 266 acts somewhat as a switch that ideally is closed at VHF frequencies to allow lengths l2+l3+l4+l5 combine to function as a half-wave RF VHF radiator 268, but at UHF frequencies acts ideally as an open switch that decouples regions 266 and 268 from region 264. Region 264+l2 then act as a half-wavelength RF UHF radiator. On the other hand, at VHF frequencies decoupling stub 266 acts like a closed switch, and antenna regions 268 and 264 (and the length of decoupling stub 266) and the slight contribution from l2 combine to form a half wavelength at VHF. Consequently antenna 260 resonates well and radiates RF well at both VHF and UHF frequencies.

DBJ-1 antenna 260 as shown in FIG. 6A has enjoyed great acceptance with the radio amateur community, as well as with numerous emergency services agencies, federal, state, and local, that rely upon VHF/UHF communications devices. More than 10,000 DBJ-1 antennas have been constructed and deployed in the U.S. and abroad. The antenna of FIG. 6A may be fabricated from 300Ω twinlead, and fed with RG174A coaxial cable, cable 60, preferably coupling to the antenna along the antenna longitudinal axis, to minimize interference with the antenna RF radiation pattern. Twinlead fabrication of antenna 260 contributed to low manufacturing cost and portability. The twinlead portion of the antenna is small and lightweight, and can be mailed to a user. If the antenna will be used mounted within a specified type of PVC tubing, the antenna twinlead (LEAD 1, LEAD 2) is pre-cut during fabrication, taking into account the PVC tubing characteristics. The pre-cut twinlead is mailed to the user with instructions to buy the specified PVC tubing locally, and mount the antenna within. A complete description of this antenna is set forth in the article "A Dual Band VHF-UHF Single Feedline J-Pole", *QST*, February 2003, vol. 87, no. 2, pages 38-40, by E. Fong, applicant herein. Further details regarding the design of antenna 220 may be found at QST magazine, February 2003, pp 38-401, E. Fong (WB6IQN), "The DBJ-1: A VHF-UHF Dual-Band J-Pole", and QST magazine, March 2007, E. Fong (WB6IQN), "The DBJ-2: A Portable VHF-UHF Roll-up J-pole Antenna for ARES".

Thus as used herein, the term DBJ-1 dual-band J-pole antenna is understood to refer to VHF-UHF twinlead antenna 260 as depicted and described above with reference to FIG. 6A. It will be appreciated that at UHF the radiating element is the lead 2 portion l5+l2, and that the the lead 1 portion above gap 240 is simply floating, does not radiate, and in fact could be removed. Similarly it will be appreciated that at VHF the radiating element is the lead 1 portion of l5+stub 366+the lead 1 portion of l3+l2, and that the lead 1 portion above gap 240 is simply floating, does not radiating, and could be removed. Thus above the level of l1, the twinlead comprising lead 1 and lead 2 could be replaced by a single wire denoted lead 2, with lead 1 being completely removed.

FIG. 6B depicts a fundamental and a third harmonic radiation pattern for a dual band J-pole such as shown in FIG. 6A, depicting radiation performance with and without UHF decoupling stub 266. In FIG. 6B, if the UHF decoupling stub were absent, radiation is the third harmonic pattern, a somewhat distorted butterfly pattern. This distortion results because the third harmonic of VHF is UHF, and has the undesired characteristic that perhaps 75% of the radiation emanates up into the sky. The fundamental radiation pattern, by contrast, results when UHF decoupling stub is used, as in antenna 260, and is a clean half wavelength dipole radiation pattern.

FIG. 7 depicts a prior art attempt to implement a triband antenna operable in the in the 2 m (144 MHz) VHF band, the 1.25 m (220 MHz) intermediate VHF-UHF band, and the 70 cm (440 MHz) UHF band. Antenna 280 in FIG. 7 is a stacked triband antenna described by J. L. Harris "A VHF/UHF) 3 Band Mobile Antenna", QST Magazine, February 1980. Antenna 280 is essentially three parallel J-pole antennas, one antenna for each of the three bands, comprising a quarter-wave wavelength stub 282 for 146 MHz, a quarter-wavelength stub 284 for 220 MHz, and a quarter-wavelength stub 286 for 445 MHz, all fabricated using soldered-together 0.5" O.D. copper plumbing pipe and copper plumbing elbow joints. These copper quarter-wavelength stubs are soldered to a vertical copper member 288, that comprises the main body of triband antenna 280.

Within hollow member 288 three lengths of coaxial cable such as 60 run vertically. One length has its center lead (shown in phantom) soldered to the shell of stub 286, and has its shield soldered to the shell of member 280 adjacent the entry hole. A second length of coaxial cable has its center lead soldered to the shell of stub 284 and its shield soldered to member 280 adjacent the entry hole. A third length of coaxial cable has its center lead soldered to the shell of stub 282, and has its shield soldered to member 280 adjacent the entry hole. At the bottom of antenna 280, all three center leads from the three coaxial cables are soldered together and to the center lead of feed coaxial cable 60, RG174A or the like. The shield of feed coaxial cable 60 is soldered to the shell of member 288 at the bottom of antenna 280. At the relevant resonant frequency band, each quarter-wave copper stub presents an approximately 50Ω impedance. Unfortunately antenna 280 in FIG. 7 lacks a mechanism to decouple the UHF radiator portion of the antenna from the VHF radiator portion, e.g., a mechanism serving the role of UHF decoupling stub 266 in DBJ-1 antenna 260 in FIG. 6A. Consequently because it is harmonically related, the VHF portion of antenna 280 will resonant at UHF frequencies, which disturbs the antenna radiation pattern at UHF. Another shortcoming is that triband antenna 280 in FIG. 7 is not especially robust, especially with the three small entry holes into the main vertical member, through which water can enter to the detriment of the center lead connections to coaxial cable 60 at the antenna bottom. Robustness is compromised by the inherent weakness of solder joints, especially in inclement weather. The overall antenna is about 1.6 m from top-to-bottom, is rigid but fragile, and is not readily shippable. However one advantage of the copper tubing fabrication is that the effective cross-section of the antenna is far greater than if twinlead were used. Consequently a copper tubing J-pole can exhibit greater bandwidth than a J-pole made of very narrow wire twinlead. However on balance, the cost, weight, lack of robustness, and difficulty in transporting a copper J-pole mitigate against using such material.

What is needed is an inexpensive, readily fabricated triband antenna that provides performance commensurate with a half wavelength vertical antenna on each band, has a virtual ground requiring no radials, provides independent adjustment, if needed, on each band without substantially affecting performance on the remaining bands. Such antenna should be collinear in form factor, robust, radiate omni-directionally, should be lightweight and inexpensive to fabricate. Further the antenna should be readily shippable and readily deployable in portable applications, and should be less than about 1.7 m in length. Finally, there should be a single antenna connection port common to all three bands such that a single external coaxial cable can be connected to the triband antenna for operation at any or all of the three bands.

The present invention provides such an antenna.

SUMMARY OF THE PRESENT INVENTION

The present invention provides a triband antenna operable with acceptable standing wave ratio (SWR) performance in the VHF (about 140 MHz-170 MHz), UHF (about 420 MHz-470 MHz), and intermediate VHF-UHF (about 220 MHz-225 MHz), bands. The antenna performs on each band with the gain of a half wavelength vertical antenna, which is to say 0 dB relative to a dipole, or 2.1 dB gain relative to an isotropic antenna. This performance is 6 dB-8 dB more gain than is provided by commonly used "rubber-duck" antennas used on many portable VHF-UHF transceivers. At VHF band and at UHF band the triband antenna is a half-wavelength end-fed vertical dipole, and at intermediate band the triband antenna is a half-wavelength center-fed vertical dipole. The triband antenna exhibits good omni-directional RF radiation performance, notwithstanding that the intermediate band is not harmonically related to the VHF or the UHF band. The triband antenna operates without radials or an absolute ground and at its bottommost region provides a low impedance antenna port to which an external coaxial cable can be coupled for antenna operation over any or all of the three bands. The other end of the external coaxial cable would be coupled to a transceiver or the like operable on any or all of the three bands. The antenna preferably is fabricated from inexpensive twinlead and may be mounted within PVC tubing, which provides protection against inclement weather, UV radiation, and enables a robust manner of antenna mounting. Triband antennas according to embodiments of the present invention can be fine-tuned on one band without affecting the other two bands, in part due to the unique topology employed.

Antenna structure at VHF and UHF frequencies is similar to a DBJ-1 dual-band J-pole preferably fabricated at least in part from twinlead comprising first and second leads. At the very bottom of the J-pole the first and second leads of the twinlead are shorted together to define a 0Ω impedance, above which at a distance Δ a nominal low impedance, e.g., about 50Ω, feedpoint pair exists. The upper end of a length Lc of coaxial cable is coupled to these feedpoints, and the lower end of this length of coaxial cable is the connection port to the triband antenna. This connection port enables one end of a length of typically 50Ω external coaxial cable to be coupled to the triband antenna, with the other end of the external coaxial cable coupled to a transceiver or the like operable on VHF and/or intermediate band and/or UHF frequencies. At the upper end of the length Lc, the coaxial cable center conductor is preferably connected to the first lead of the twinlead at the low impedance feedpoint, and the braid shield of the coaxial cable is connected to the second lead of the twinlead at the low impedance feedpoint, although these two connections of the upper end of the Lc length of coaxial cable could be reversed. A notch is cut in the first lead a distance above the low impedance feedpoint, to define in the twinlead below the notch a passive, non-radiating, impedance matching transformer antenna region. This impedance matching transformer region is a quarter wavelength at VHF frequencies and a three-quarter wavelength at UHF frequencies. Above the notch cut in the first lead is a length of twinlead that is a half wavelength radiator at UHF frequencies. A UHF decoupling stub is disposed in the second lead above the UHF radiator. This UHF decoupling stub exhibits high impedance at UHF frequencies and serves to decouple the UHF half-wavelength radiator below this stub from the remainder of the antenna above the stub. The first lead in the twinlead is cutaway opposite the UHF decoupling stub in the second lead of the twinlead. Above the UHF decoupling stub is a length of twinlead representing a portion of the radiator at VHF frequencies. At VHF frequencies the UHF decoupling stub essentially couples the upper end of the UHF half-wavelength radiator and the length of the UHF decoupling stub itself to the VHF radiator to collectively form a half-wave radiator at VHF frequencies. The UHF decoupling stub may be implemented as a quarter wavelength of coaxial cable whose center conductor is shorted to the coaxial cable shield at the top of the quarter wavelength, but is not shorted at the bottom. At a quarter wavelength the zero impedance at the top of the UHF decoupling stub transforms to an open or high impedance at the bottom of the stub.

The radiating element for the intermediate band is formed as first and second helical windings of electrical wire, whose combined stretched-out length is a half wavelength at the intermediate band. The first helical winding is wound around the passive, non-radiating quarter wavelength/three-quarter wavelength impedance matching transformer at the bottom of the DBJ-1 J-pole antenna. The length of the first helix may extend from the antenna feedpoint region upwards to the notch cut in the first lead. The upper end of the first helix is not connected to anything, whereas the lower end of the first helix is connected to one of the two low impedance feedpoints, perhaps the feedpoint in the first lead of the twinlead. The second helix is wound around the upper region of the Lc length of coaxial, with the upper end of the second helix connected to the remaining low impedance feedpoint, perhaps the feedpoint in the second lead of the twinlead. The lower end of the second helix is not connected to anything. The unwound stretched-out length of the each helix is about 12", a quarter wavelength at the intermediate band, and the top-to-bottom length of each helix is Lx1 or Lx2, about 7" each. The diameter of each helix preferably is such that the finished antenna can fit within the diameter of commonly available PVC pipe, perhaps 0.75" O.D. PVC pipe.

As noted, the region of the antenna about which the first helical radiator for the intermediate band is wound is passive and non-radiating. Similarly the region of the coaxial cable about which the second helical radiator for the intermediate band is wound is passive and non-radiating. Consequently antenna RF radiation at the intermediate band does not interfere with antenna RF radiation at VHF or UHF frequencies. Similarly the VHF and UHF radiating portions of the antenna do not interfere with antenna RF radiation in the intermediate band. The radiators for the intermediate band are helically and concentrically disposed relative to the length or longitudinal axis of the antenna, and the radii of the helix windings are much less than an intermediate band wavelength. Consequently and advantageously, adverse magnetic coupling between the helical windings and the rest of the antenna is substantially reduced and a good RF radiation pattern exists on each of the three bands.

Adjustments made to antenna lengths in one or more of the three bands do not affect antenna performance in the remaining bands, which advantageously simplifies final adjustment. The total length of the overall antenna, from top to bottom of the Lc length of coaxial cable, is about 64", which is a practical length to protectively house the antenna within 0.75" diameter PVC pipe for protection against weather, UV radiation that could damage the twinlead, and to facilitate outdoor robust mounting of the triband antenna. The cost of the antenna materials is minimal, and an assembled antenna may be mailed in a lightweight package, with instructions to the end user to purchase the PVC pipe and mount the assembled antenna within. As the velocity factor associated with the PVC pipe affects the antenna performance, the detuning effects of the PVC pipe are taken into account when fabricating the antenna, individually and in mass production quantities.

Other features and advantages of the invention will appear from the following description in which the preferred embodiments have been set forth in detail, in conjunction with their accompanying drawings.

DETAILED DESCRIPTION OF THE PREFERRED EMBODIMENT

Figure 1A:
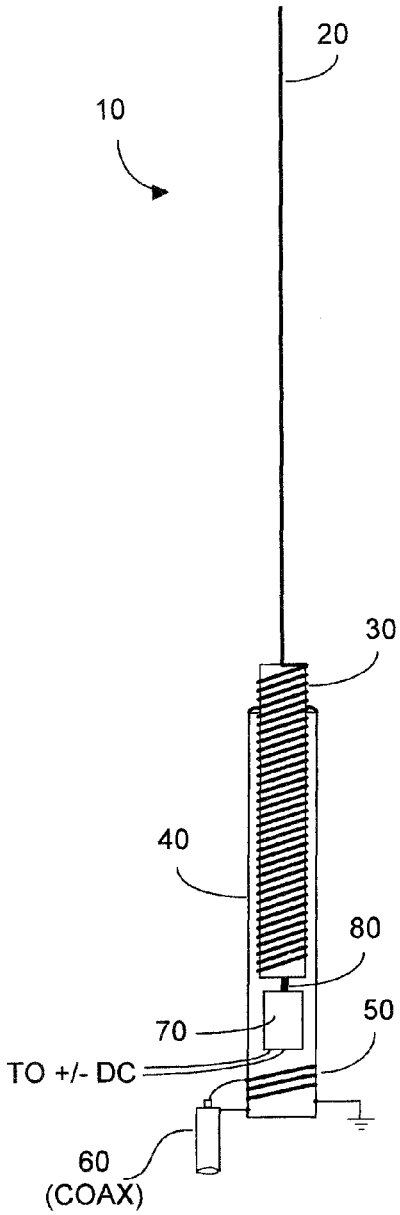
FIG. 1A (PRIOR ART)
FIGS. 1A and 1B depict a wide-frequency range, omni-directional Don Johnson type screwdriver antenna, according to the prior art.
Figure 1B:
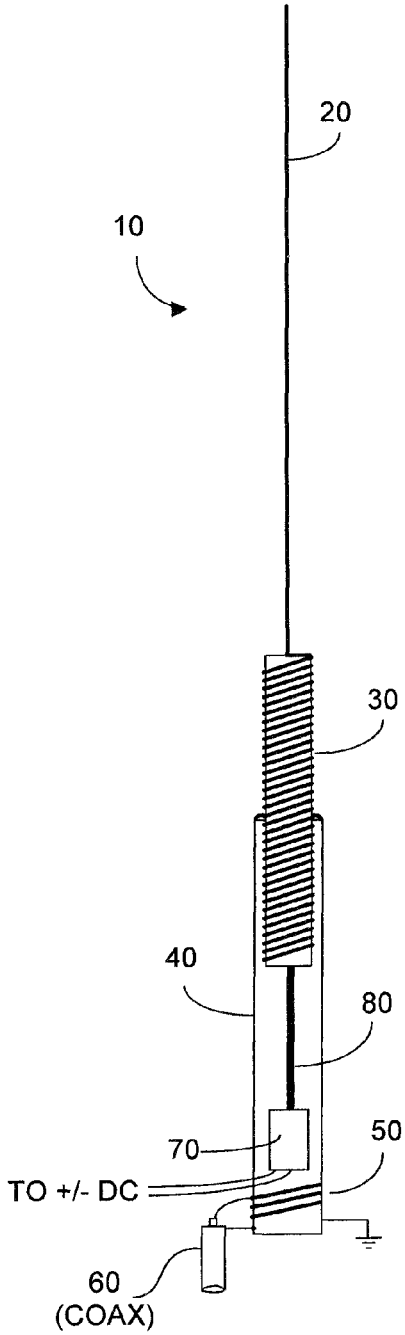
FIG. 1B (PRIOR ART)
Figures 2A, 2B:
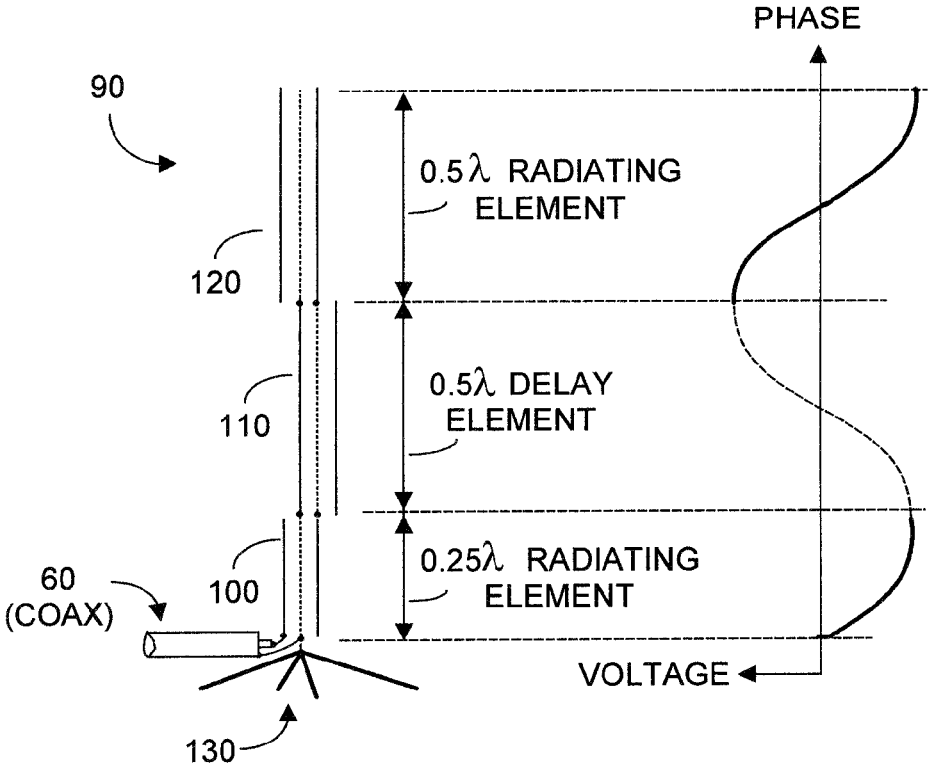
FIG. 2A (PRIOR ART)
FIG. 2B (PRIOR ART)
FIG. 2A depicts an omni-directional collinear antenna that requires radials, according to the prior art.
FIG. 2B depicts voltage amplitude versus phase for various elements of the collinear antenna of FIG. 2A, according to the prior art.
Figure 3:
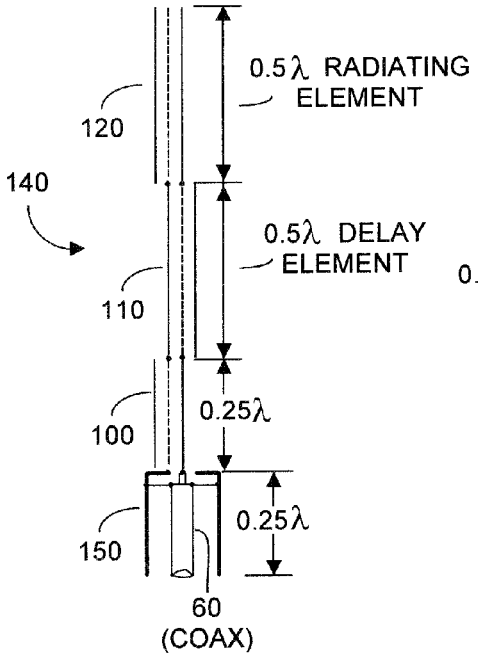
FIG. 3 (PRIOR ART)
FIG. 3 depicts an omni-directional collinear antenna that uses a quarter-wave sleeve rather than radials, according to the prior art.
Figure 4:
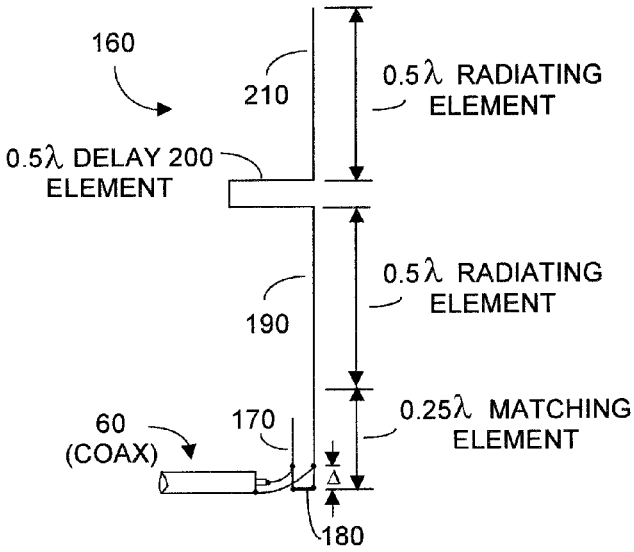
FIG. 4 (PRIOR ART)
FIG. 4 depicts a so-called "Super-J" omni-directional antenna with a half-wave delay element that operates without radials, according to the prior art.
Figure 5:
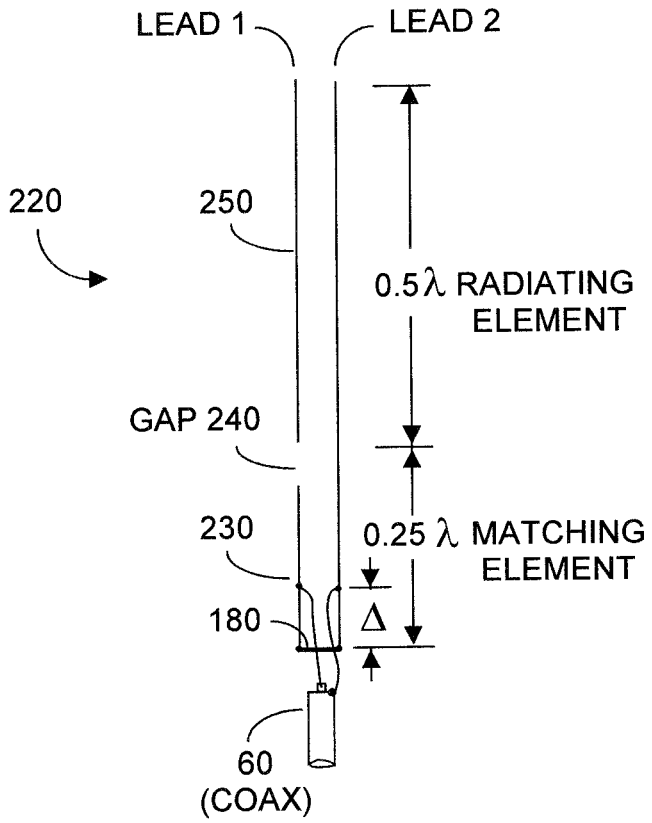
FIG. 5 (PRIOR ART)
FIG. 5 depicts a mono-band omni-directional "J-pole" antenna with slight gain that operates without radials, according to the prior art.
Figure 6B:
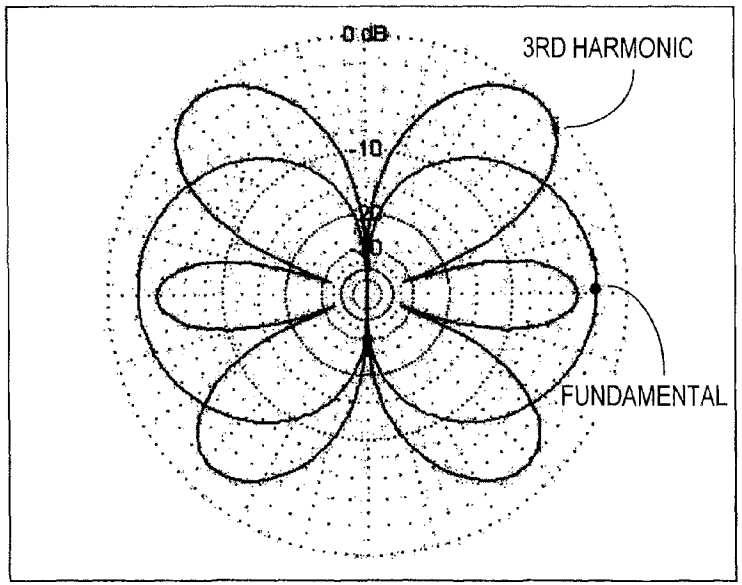
FIG. 6B (PRIOR ART)
FIG. 6B depicts the irregular radiation pattern that would result if the DBJ-1 antenna of FIG. 6A omitted a UHF decoupling stub, according to the prior art.
Figure 6A:
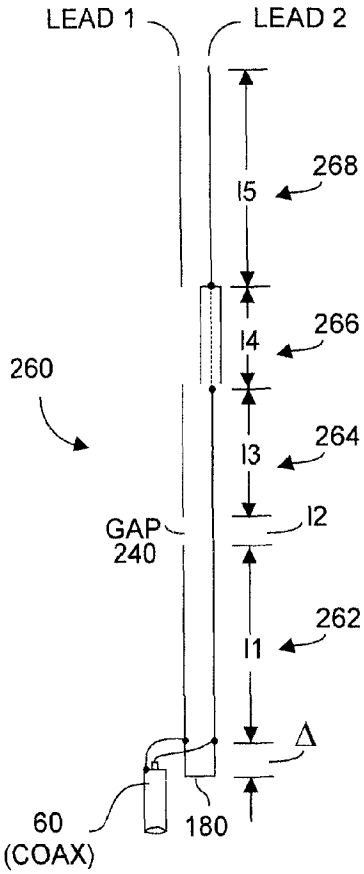
FIG. 6A (PRIOR ART)
FIG. 6A depicts a DBJ-1 (WB6IQN) dual-band J-pole antenna that operates without radials, according to the prior art.
Figure 7:
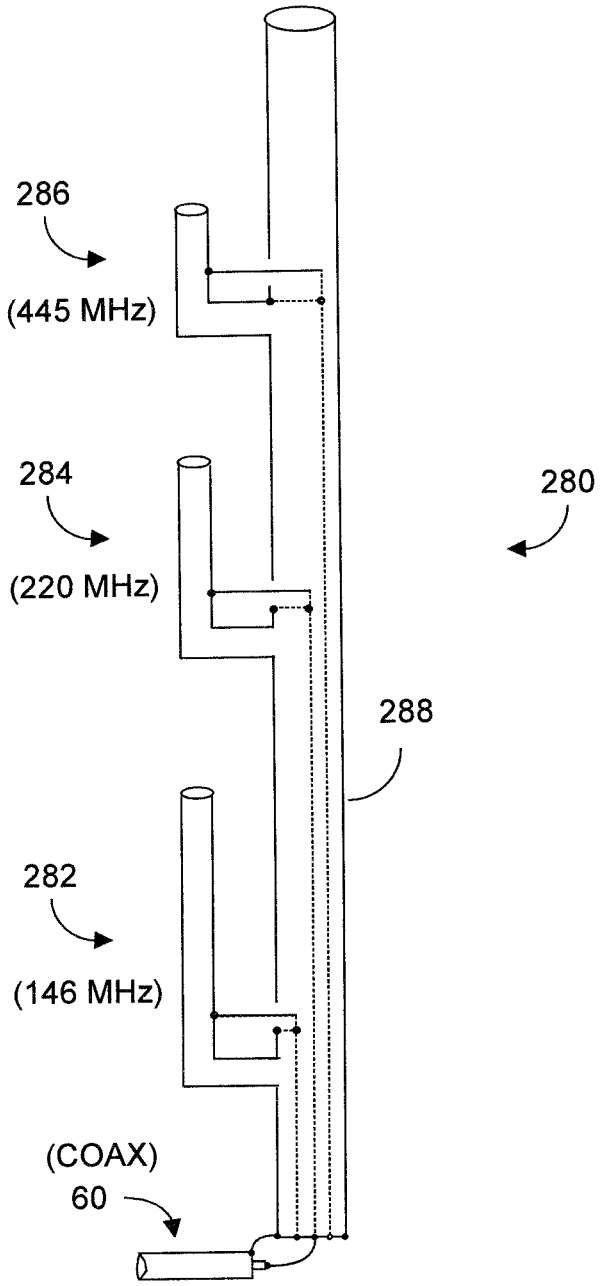
FIG. 7 (PRIOR ART)
FIG. 7 depicts a triband J-pole comprising three parallel coupled J-poles fabricated from copper tubing, according to the prior art.
Figure 8:
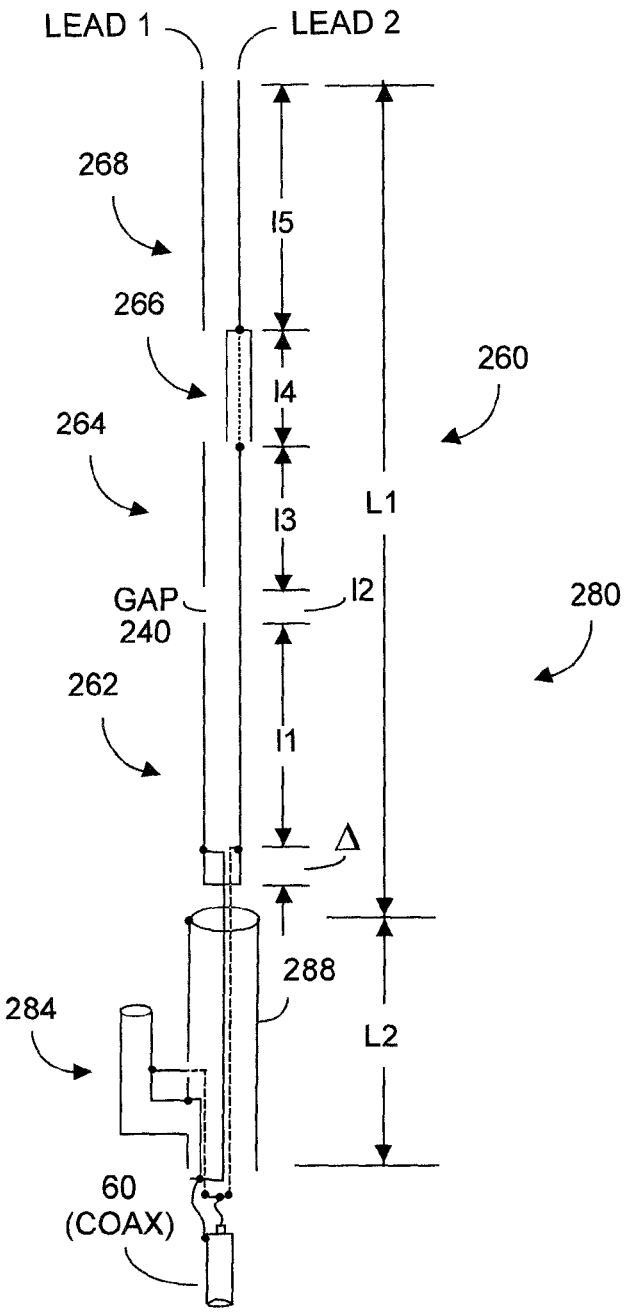
FIG. 8 depicts a triband antenna comprising a DBJ-1 dual-band (VHF-UHF) J-pole antenna coupled at the low impedance feedpoint region to a 220 MHz copper pipe J-pole antenna, according to a first experimental prototype of the present invention.

FIG. 8 depicts applicant's initial attempt to design a triband antenna. Antenna 280 comprises a DBJ-1 (WB6IQN) dual-band VHF-UHF stacked J-pole twinlead antenna portion 260 (similar to antenna 260 in FIG. 6A), comprising sections 262, 264, 266, and 268. However at the bottom of the passive non-radiating impedance transform section 262 of VHF-UHF J-pole 260 there is coupled a 220 MHz 0.5" diam. copper J-pole antenna portion 288 with copper quarter-wavelength stub 284 (similar to the 220 MHz portion 284 of antenna 280 in prior art FIG. 7). Two lengths of coaxial cable, e.g., RG174A or the like, are disposed within copper antenna portion 288. The center conductor of one coaxial cable is coupled to lead 2 of the above-lying stacked J-pole assembly, and the center conductor of the other coaxial cable exits via an entry hole from member 288 and is soldered to the shell of copper stub member 286. The ground shield of this second coaxial cable is soldered the copper housing 288 near the exit hole. At the bottom of the overall antenna, the two center conductors are joined together to the feed coaxial cable 60 center conductor. The shield of cable 60 is soldered to copper member 288 as shown.

Referring still to FIG. 8, the resultant antenna 280 did perform well as a triband antenna in the 2 m, the 1.25 m, and the 70 cm frequency ranges. The dual-band J-pole portion 260 of antenna 280 may be sized similarly to antenna 260 shown in FIG. 6A: l5 was about 17", UHF decoupling stub 266 was a length l4 of about 4.25" length l2 of RG174A coaxial cable, the l3 portion of 264 was about 11.25", gap 240 was length l2 of about 0.25", length l1 of portion 262 was about 16", and distance Δ was about 1.25". (These dimensions assume that the dual-band J-pole antenna portion 260 will be encased in PVC tubing.) However the overall vertical size of antenna 280 was too large: L1 was about 49", and L2 was about 36" for a total vertical size of about 85" or about 2.2 m. The antenna vertical size and the presence of the soldered copper pipe region 286, 288 caused applicant to reject this initial design.

Figure 9:
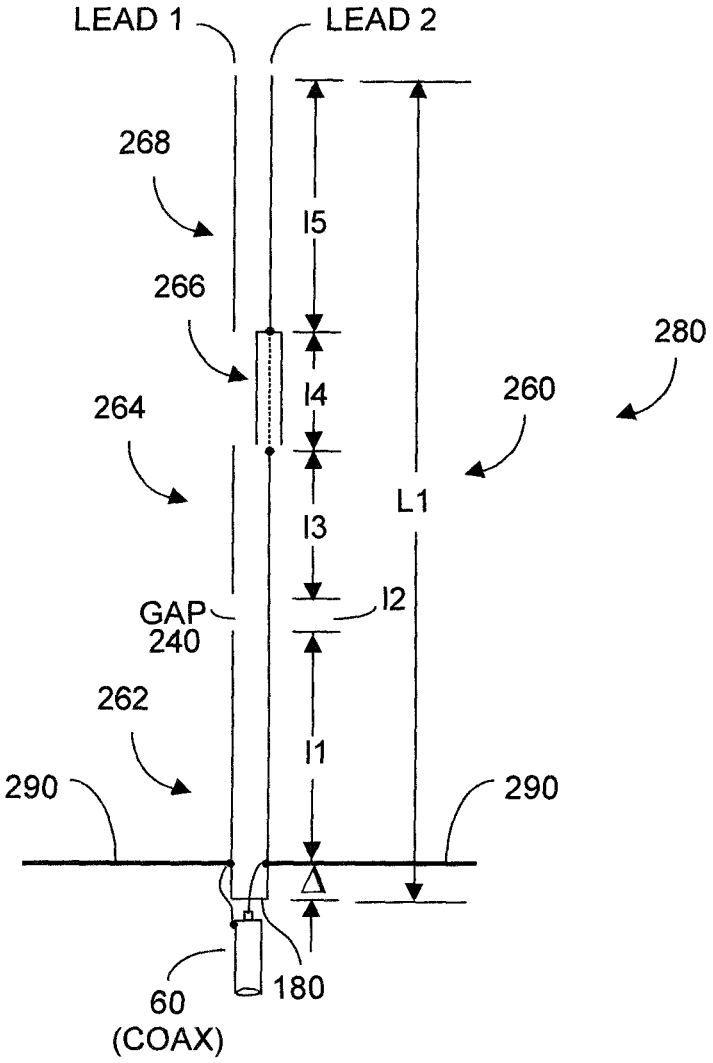
FIG. 9 depicts a triband antenna comprising a DBJ-1 dual-band (VHF-UHF) J-pole antenna coupled at the low impedance feedpoint to a 220 MHz horizontal dipole, according to a second experimental prototype of the present invention.

The configuration of FIG. 9 was next investigated by applicant, wherein a DBJ-1 (WB6IQN) dual-band VHF-UHF twinlead antenna portion 260 (similar to antenna 260 in FIG. 6A) includes a horizontally disposed 220 MHz dipole comprising elements 290, each element 290 being a quarter wavelength at 220 MHz (about 12" in length). The 220 MHz dipole elements 290 are coupled preferably at the dual-band J-pole antenna low impedance feedpoints, whereat coaxial cable 60 is connected. Dimensions l1, l2 (gap), l3, l4 and l5 are similar to what has been given with respect to the dual-band J-pole antenna configuration portions shown in FIG. 6A and FIG. 8. Triband antenna 280 had overall height L1 about 49". While antenna 280 exhibited triband functionality in the 2 m, 1.25 cm, and 70 cm bands, unfortunately the horizontally disposed radial-like 220 MHz dipole 290 radiated RF horizontally, whereas the vertically disposed 2 m and 70 cm portions of the antenna radiated RF vertically, as is generally preferred. Further horizontally extending 220 MHz dipole elements 290 reduced robustness of overall antenna triband antenna 280.

Figure 10:
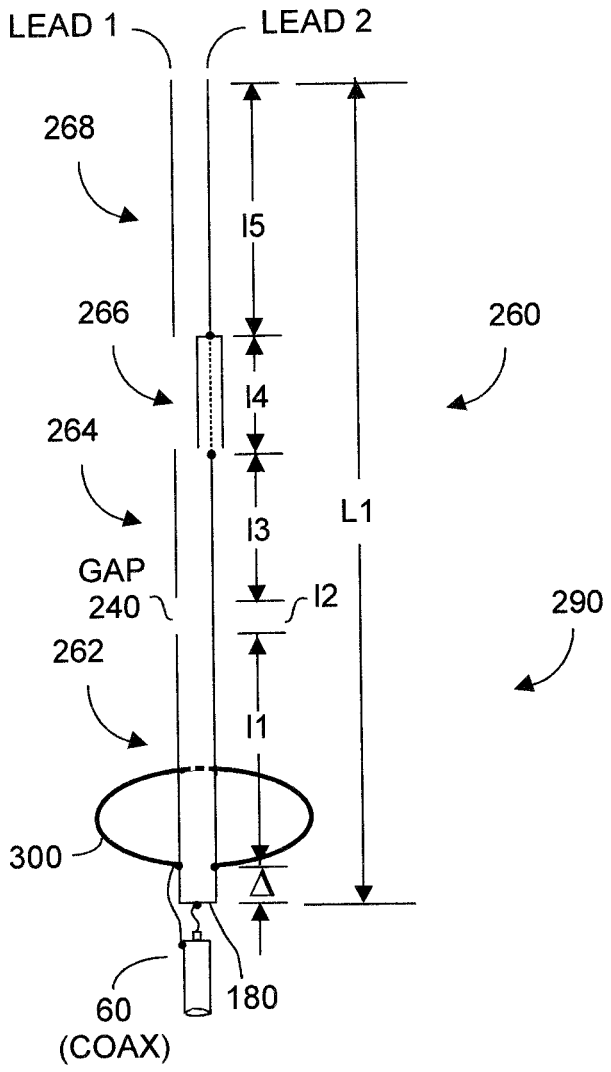
FIG. 10 depicts a triband antenna comprising a DBJ-1 dual-band (VHF-UHF) twinlead J-pole antenna coupled at the low impedance feedpoints to a 220 MHz horizontally disposed segmented hoop element concentric about the antenna length, according to a third experimental prototype of the present invention.

Applicant next experimented with the triband antenna configuration shown in FIG. 10. The upper portion of triband antenna 290 comprises a DBJ-1 (WB6IQN) dual-band stacked J-pole VHF-UHF twinlead antenna portion 260 (similar to antenna 260 in FIG. 6A, and antenna portions 260 in FIG. 8, FIG. 9, and FIG. 10), coupled preferably at the low impedance coaxial cable 60 feedpoints to a horizontally disposed 220 MHz segmented circular hoop element 300 made of wire and having a circumference of about 24", e.g., a half wavelength at 220 MHz. Element 300 is two semi-circles. One end of each semi-circle terminates at one of the two low impedance feedpoints, and the other end of each semi-circle is separated from the other end of the other semicircle by a small insulation piece, shown in phantom in FIG. 10. The vertical axis of antenna 290 lies through the center of the twinlead and passes through the center of the plane of circular hoop element 300, which extends outward from the vertical axis with a radius of about 3.8". To minimize interaction with the main J-pole configuration, circular hoop element 300 wants to stand off and away from the J-pole at the feedpoints by at least 1".

Understandably having to secure segmented circular half wavelength element 300 to J-pole 260 decreases robustness of the overall antenna. In FIG. 10, dimensions l1, l2, l3, l4, l5 are similar to that given with respect to antennas shown in FIG. 6A and FIG. 8, with overall height L1 being about 49". While antenna 290 functioned as a working triband antenna, horizontally disposed hoop element 300 radiated RF at 220 MHz substantially horizontally rather than the more preferred vertical radiation. However in the embodiment of FIG. 10 it was realized that disposing the 220 MHz element 300 coaxially about the length of J-pole antenna 260 advantageously kept 220 MHz RF radiation from substantially interfering with RF radiation in the 140 MHz band or the 440 MHz band, and vice versa. All in all the configurations of FIG. 9 and FIG. 10 encouraged applicant that his experiments were leading in a proper direction, and that a practical triband antenna design might be attainable notwithstanding that the desired third (intermediate) band was not harmonically related to either the VHF or UHF bands.

Figure 11A:
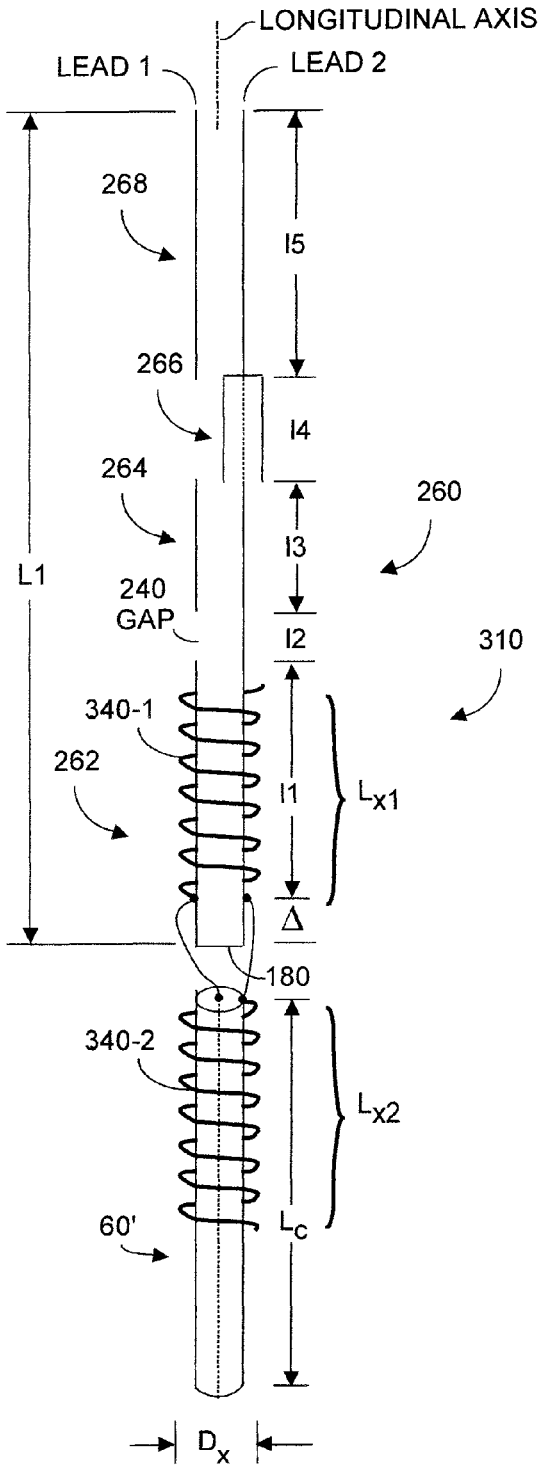
FIG. 11A depicts a triband antenna comprising a DBJ-1 dual-band (VHF-UHF) twinlead J-pole antenna coupled at the low impedance feedpoints to a first 220 MHz quarter wavelength length of wire coaxially disposed around the passive non-radiating impedance matching region of the J-pole antenna, and a second 220 MHz quarter wavelength length of wire coaxially disposed around the upper region of the coaxial cable connected to the triband antenna, according to preferred embodiments of the present invention.

FIG. 11A depicts a triband antenna 310, according to embodiments of the present invention that satisfies the initially stated design criteria. The upper portion of triband antenna 310 includes a DBJ-1 dual band J-pole 260 as has been described with respect to FIG. 6A, and the upper portions of the antenna structures shown in FIGS. 8, 9, and 10. Thus looking at antenna 310 from the top down, uppermost is a portion of the VHF RF radiator 268 of length l5 (about 17"), below which in LEAD 2 appears UHF decoupling stub 266, preferably a length l4 (about 4.25") of RG74A coaxial cable With the outer shield connected at the top to the coaxial cable center conductor, but open at the bottom end of the decoupling stub. As noted the short at the top of decoupling stub 266 translates at a quarter wavelength of UHF to an open circuit at the bottom of the stub. Continuing downward with antenna 310, beneath UHF decoupling stub 266 occurs UHF radiator 264 of length l3 (about 11.25"), a half wavelength at UHF. At UHF frequencies, decoupling stub 266 appears somewhat like an open circuit and decouples the portions of the antenna higher than element 264, which allows element 264+l2 to operate as a half wave UHF RF radiator. However at VHF frequencies, decoupling stub 266 acts somewhat like a short circuit, allowing a half wave VHF RF radiator to be formed from the series-connected combination of antenna portions l2+264, 266, and 268.

Continuing further downward, a gap 240 is cut in LEAD 1 with gap height l2 of about 0.25" to isolate UHF radiating element 264 from lower sections of the antenna. Below gap 240 is found the passive non-RF radiating impedance transforming section 262, having length l1 of about 16". As noted, section 262 acts as a quarter wavelength impedance stub at VHF and acts as a three-quarter wavelength stub at UHF, as the UHF band is an odd harmonic (third harmonic) of the VHF band. The bottommost region of DBJ-1 dual-band J-pole 260 is shorted together at 180, and at a distance Δ (about 1.25") above the short there is found a low impedance region (about 50Ω) whereat first and second feedpoints are present. A length Lc, typically about 14", of coaxial cable 60', e.g., RG174A, has its upper end connected to the two feedpoints. For example the center conductor of cable 60' may be connected to the first feedpoint on LEAD 1 and the braid shield of cable 60' may be connected to the second feedpoint on LEAD 2, or vice versa. As shown in FIG. 11A, the center conductor of coaxial cable 60 (typically RG174A) connects to one feedpoint, while the braid shield of the coaxial cable 60 connects to the other feedpoint. The bottommost portion of length Lc of coaxial cable 60' is the antenna port for triband antenna 260, the region whereat an external length of coaxial cable (who other end is connectable to a transceiver or the like) may be connected to the triband antenna.

Thus far antenna 310 as described implements performance on the VHF band and the UHF band. Triband antenna performance at intermediate band (about 220 MHz-225 MHz) as provided in preferred embodiments of the present invention will now be described. Intermediate band functionality is created by providing near the bottom portion of antenna 310 a half wave RF radiator at intermediate band frequencies, comprising a first quarter wavelength of wire 340-1 and a second quarter wavelength of wire 340-2. Each wire 340-1, 340-2 if stretched out would be a quarter wavelength at the intermediate band, about 12" length. Adequate stiffness is provided by single 16 gauge wire for 340-1, 340-2. As noted from applicant's earlier experiments with the triband antenna configurations of FIG. 9 and FIG. 10, the intermediate band elements should have minimal adverse magnetic coupling effects that could distort good patterns of RF radiation on each of the three bands. It is further desired to maintain a compact and robust form factor for antenna 310. Thus the first quarter wavelength of wire 340-1 is wrapped helically about at least a portion of the passive non-RF radiating impedance transforming section 262 of the antenna, namely a helix top-to-bottom length Lx1 of the length l1 of section 262. The bottom end of wire 340-1 is attached to one of the two low impedance feedpoints, and the upper end of wire 340-1 is left floating. Length 11 of impedance transforming section 262 is about 16", and the wound top-to-bottom helix length for wire 340-1 Lx1, about 7". The second quarter wavelength of wire 340-2 is wrapped around a length Lc, preferably about 14") of the upper approximately half of coaxial cable 60' and will have a wound top-to-bottom helix length Lx2, which occupies about half of length Lc. Length Lx1 and length Lx2 may but need not be equal and will be in the range of 6" to about 8". Length Lc could be much longer than 14", e.g., many feet, but an approximate 14" length is convenient for mounting the antenna, which includes length Lc, within PVC tubing of reasonable height.

Figure 11B:
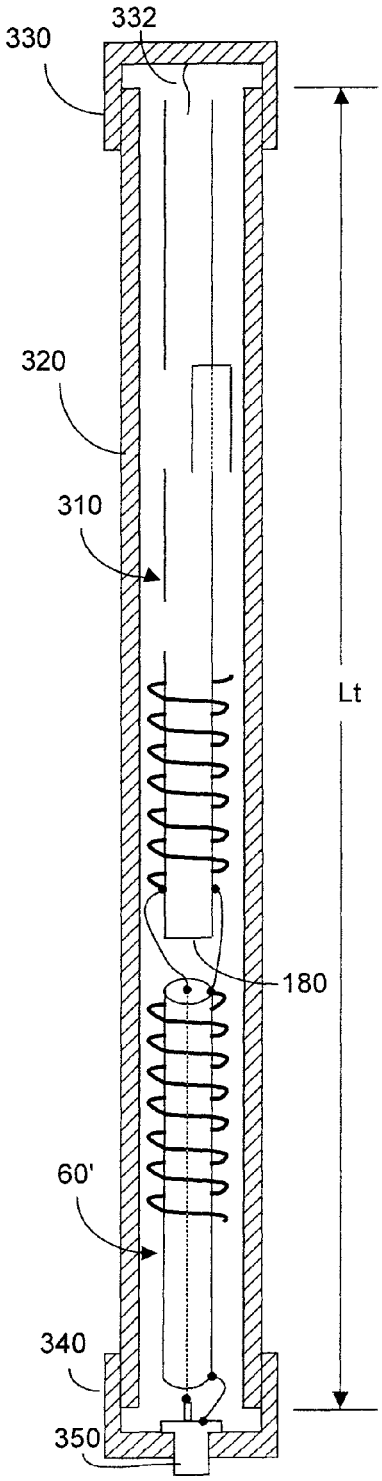
FIG. 11B depicts the triband antenna of FIG. 11A mounted within a protective length of end-capped PVC pipe, according to preferred embodiments of the present inventions.

In FIG. 11A, wire 340-1 and wire 340-2 should each be wound in the same direction, e.g., both wound clockwise or both wound counter-clockwise, to avoid distortions in the generated RF pattern. In the embodiment shown in FIG. 11A, the upper end of wire 340-2 is connected to the remaining low impedance feedpoint, while the lower end of this wire is left floating, e.g., is not connected to anything. If desired the helix winding connections to the two feedpoints could be reversed. Better intermediate band RF radiation occurs if helical windings 340-1, 340-2 are stretched out with a smaller turns/inch pitch (without overlying an active portion of the antenna), rather than wound very closely together. In practice a winding pitch of about one turn/inch works out well. If diameter Dx of the two helical windings were too large, magnetic effects could distort RF radiation at intermediate band frequencies, which is not desired. Note that winding 340-2 preferably is not allowed to simply fall vertically, as it would then be parallel to coaxial cable 60', and its magnetic field would distort the RF radiation pattern, and adversely affect the impedance matching, or SWR. In practice Dx preferably is small such that triband antenna 310 can fit within a length of 0.75" O.D. 200 PSI PVC pipe, e.g., Dx< 0.75". Such PVC pipe or tubing provides protection for the antenna within against inclement weather, UV radiation that can weaken the twinlead, and facilitates robust outdoor mounting. FIG. 11B depicts such installation.

It is noted in FIG. 11A, that both quarter-wavelength windings 340-1, 340-2 are wound helically advantageously about passive, non-RF radiating regions of triband antenna 310. As noted region 262, about a portion of which is wound first helix 340-1, is simply an impedance transformer and radiates no RF at any band. Further, coaxial cable 60 has, by definition, a surrounding braid shield and is also passive, and radiates no RF at any band. Thus, second helix 340-2 is thus also wound about a passive, non-RF radiating element. This coaxial helical disposition of the vertically disposed intermediate band RF radiating elements 340-1, 340-2 relative to the longitudinal axis of triband antenna 310, and the relatively small helix diameter Dx, e.g., < 0.75", relative to 220 MHz quarter wavelengths (about 6") minimizes adverse magnetic coupling effects. Advantageously this results in maintaining a low SWR in each of the three bands, and also promotes a substantially undistorted intermediate band RF propagation pattern. The radiating elements for VHF, UHF are each half wavelength end-fed vertical dipoles, and the radiating element for intermediate band operation is a half wavelength center-fed vertical dipole. Consequently there is substantial elimination of cross-band radiation interference between VHF, intermediate band, and UHF operation, and no substantial degradation of triband antenna performance.

As noted, dimensions given for antenna 310 are approximate within a few percent, and assume the finished antenna will be mounted within PVC tubing, as in FIG. 11B. Were such not the case, the various dimensions would be increased by about 4%-5%. Dimensions may also vary, for example, if twinlead having a different velocity factor is used to make antenna 310. In general, overall length Lx of triband antenna 310 will be about 64" or about 1.6 m. (If antenna 310 is deployed within protective PVC tubing, the tubing length with endcaps may be about 1.7 m.) Note too in FIG. 11A that coaxial cable 60' is connected to and drops down vertically and substantially parallel to the longitudinal axis of the remainder of triband antenna 310. This disposition advantageously reduces the potential for this length Lc of coaxial cable 60' to physically interfere with radiated RF at any of the three bands.

In practice an antenna 310 is cut and assembled and is then inserted into a length of appropriate PVC tubing such as 320 in FIG. 11B. Antenna characteristics are then measured at UHF, at intermediate band, and at VHF frequencies, using a network analyzer (e.g., an Agilent 8753D) or an antenna analyzer (e.g., an MFJ-269 Pro). Instruments such as these can measure the complex impedance of triband antenna 310 at frequencies in each band, and can measure the standing wave ratio (SWR) at different frequencies in each band. Ideally impedance should be about 50Ω with no substantial complex component, and ideally SWR is 1:1. Adjustments to the characteristics of antenna 310 can generally be made at UHF by changing slightly the magnitude of l2, usually by cutting away slightly more material from the bottom of the gap. Next antenna 310 is characterized at VHF, with adjustments made to the upper end of l5. Finally the antenna is characterized at the intermediate band by slightly compressing or extending both helixes 340-1, 340-2, preferably equally. Advantageously the topology of the preferred embodiments allow these adjustments to be made without disrupting adjustments already made on the other bands. Once an individual triband antenna 310 has been fine-tuned per the above procedure or equivalent, the antenna can be permanently inserted into PVC tubing as shown in FIG. 11B, and described below.

As shown in FIG. 11A and FIG. 11B, triband antenna 310 comprises 300Ω twinlead with a small, typically 4.24" section of coaxial cable (UHF decoupling stub 266 two lengths of preferably 16 gauge wire (340-1, 340-2), and an approximately 14" length of coaxial cable 60'. These components are relatively lightweight and inexpensive, and can be rolled up and mailed as a lightweight package to an end user. If the antenna was cut and dimensioned for use within PVC tubing, preferably the antenna, but not PVC tube 320 (see FIG. 11B), is mailed to the end user with instructions to obtain the specific type of PVC tubing 320 locally, e.g., 0.75" OD 200 PSI PVC, for which the antenna was designed, and to insert the antenna within and then cement on PVC end caps. If desired, PVC upper end cap 330 with nylon string or the like 332 glued to the inner cap surface to secure the upper end of antenna 310 through a hole in the uppermost portion of the plastic twinlead material (not shown to avoid cluttering the drawings), and lower end cap 344 with coaxial antenna connector 350 attached, may be mailed to the end user along with the rolled-up antenna and instructions.

In some embodiments it may be desired to always deploy the antenna without protective PVC tubing. In such cases the antenna dimensions will typically be 4%-5% greater than those given for in-PVC tubing embodiments due to the change in velocity factor of PVC vs air, and characterization of the antenna will take place in open air, using the exemplary procedure noted above. As such, the rolled up antenna, without end caps, and with a coaxial or other connector attached to the bottom end of coaxial cable 60', or indeed with length Lc increased to several feet is lightweight and compact. The antenna can be kept in a vehicle glove compartment, in a desk drawer, or even in a shirt pocket, for deployment when needed, often with a handheld handi-talkie transceiver. In such applications the typically 6 dB-8 dB gain realized by a triband antenna according to embodiments of the present invention over the performance of a typical so-called rubber duck antenna used on such devices is very substantial. If Lc is several feet in length, antenna 310 may be suspended from a tree branch or a house door, to provide a bit of elevation.

As noted earlier, portions of lead 1 in regions 268 and 264 are simply floating and do not radiate RF and these portions of lead 1 could be omitted. If desired, lead 2 in regions 268, 264, and 240 could simply be a single wire. As such, a triband antenna according to the present invention may be said to be fabricated at least in part from twinlead. In some embodiments, the twinlead runs the full length L1 of the dual-band J-pole antenna portion of the triband antenna, and in other embodiments twinlead may only be the length of Δ+l1 or Δ+l1+l2 (with gap 240 formed in lead 1). In such latter embodiments, there would be no lead 1 higher than gap 240, and lead 2 may be a single wire, but not necessarily wire in a portion of twinlead.

FIG. 11B depicts triband antenna 310 as shown in FIG. 11A, mounted within a length Lt, typically about 65"-66" (about 1.7 m), of preferably 0.75" O.D. 200 PSI PVC tubing 320. The top of antenna 310 can be suspended with a nylon string 332 or the like from the inner surface of PVC end cap 330, perhaps with glue. Antenna 310 then extends downward within tubing 320 and at the bottommost end, a coaxial or other bulkhead type receptacle 350 is attached to a bottom PVC end cap 340. This receptacle attaches to the lower end coaxial center conductor and braid shield of coaxial cable 60' is becomes the connection port triband antenna 310. Exemplary such receptacles include an SO-239 connector, N-type, or chassis mount screw type Amphenol® 554-77 connector. The upper and lower PVC end caps may be permanently attached to PVC tube 320, i.e., with adhesive. In use, an external length of coaxial cable 60 (see FIG. 13) with a suitable mating plug simply attaches to the bottom of antenna 310 at connector 350. The bottom 7"-8" of PVC 320 surrounds only the passive, non-radiating bottom portion of coaxial cable 60'. This readily enables clamping the bottom portion of the tubing, and thus the antenna, to a metal vent pipe (see 355 in FIG. 13) or the like.

Figure 12A:
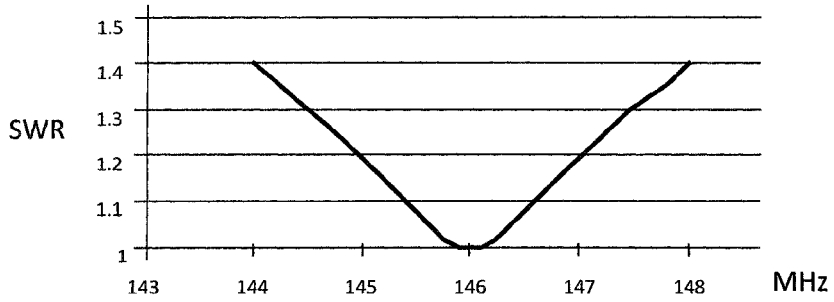
FIG. 12A, FIG. 12B, FIG. 12C depict respective acceptably good SWR vs. frequency characteristics for the 2 m, 1.25 m, and 70 cm frequency ranges of the triband antenna of FIG. 11A, according to preferred embodiments of the present invention.
Figure 12B:
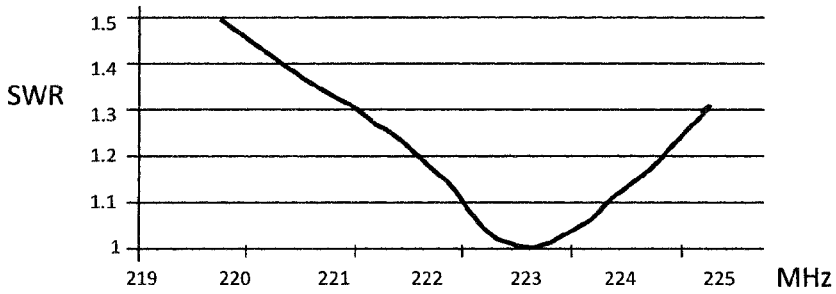
Figure 12C:
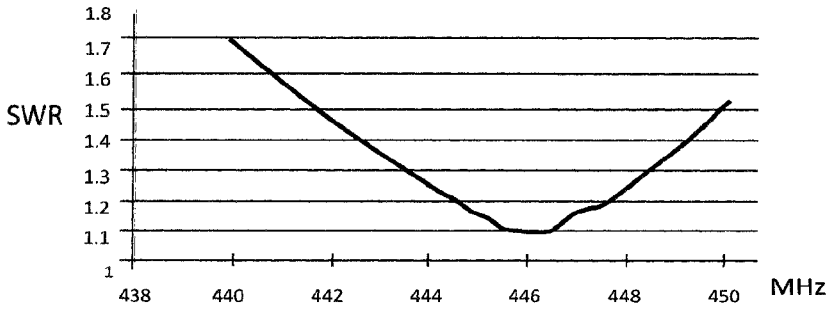

FIG. 12A, FIG. 12B, and FIG. 12C respectively depict standing wave ratio (SWR) vs. operating frequency for operation in the radio amateur VHF band, the intermediate VHF-UHF band, and the UHF band for triband antenna 310 as shown in FIG. 11A. In an ideal world with a perfect antenna the SWR would be 1:1 at all frequencies. However in practice an SWR≤1.5:1 or so is acceptable. As such, the data in FIG. 12A, FIG. 12B, and FIG. 12C demonstrate that a very acceptable SWR is present when using the triband antenna of FIG. 11A on any or all of the three bands for which it is designed. As noted, fine tuning antenna 310 to optimize performance on one of the three bands advantageously does not substantially affect performance on the remaining bands Turning now to FIG. 13 various deployments of triband antenna 310 as described in FIG. 11A are shown. For example at the upper left portion of FIG. 13 antenna 310 is depicted in phantom mounted to a vent pipe 355 on a house roof within a length of PVC pipe 320 having a top end cap 330 and a bottom end cap 340, with receptacle connector 350 at the bottom, similarly to what was described in FIG. 11B. After exiting the bottom of antenna 310, coaxial cable 60 enters the house adjacent a window and is shown coupled to the RF connector of an electronic device 360, e.g., a transceiver, receiver, or transmitter suitable for use at the wavelengths for which triband antenna 310 was designed. Typically electronic device 360 is a transceiver, which means it can transmit and can receive at the frequencies of interest. Often device 360 will communicate via a repeater 370, which can receive a relatively weak incoming signal, perhaps from device 360, and rebroadcast it, typically on a different frequency or band, often using an antenna disposed in a favorable location, perhaps atop a tall tower. Of course device 360 can also communicate directly with other equipment 360, without recourse to a repeater, e.g., in so-called simplex mode.

Figure 13:
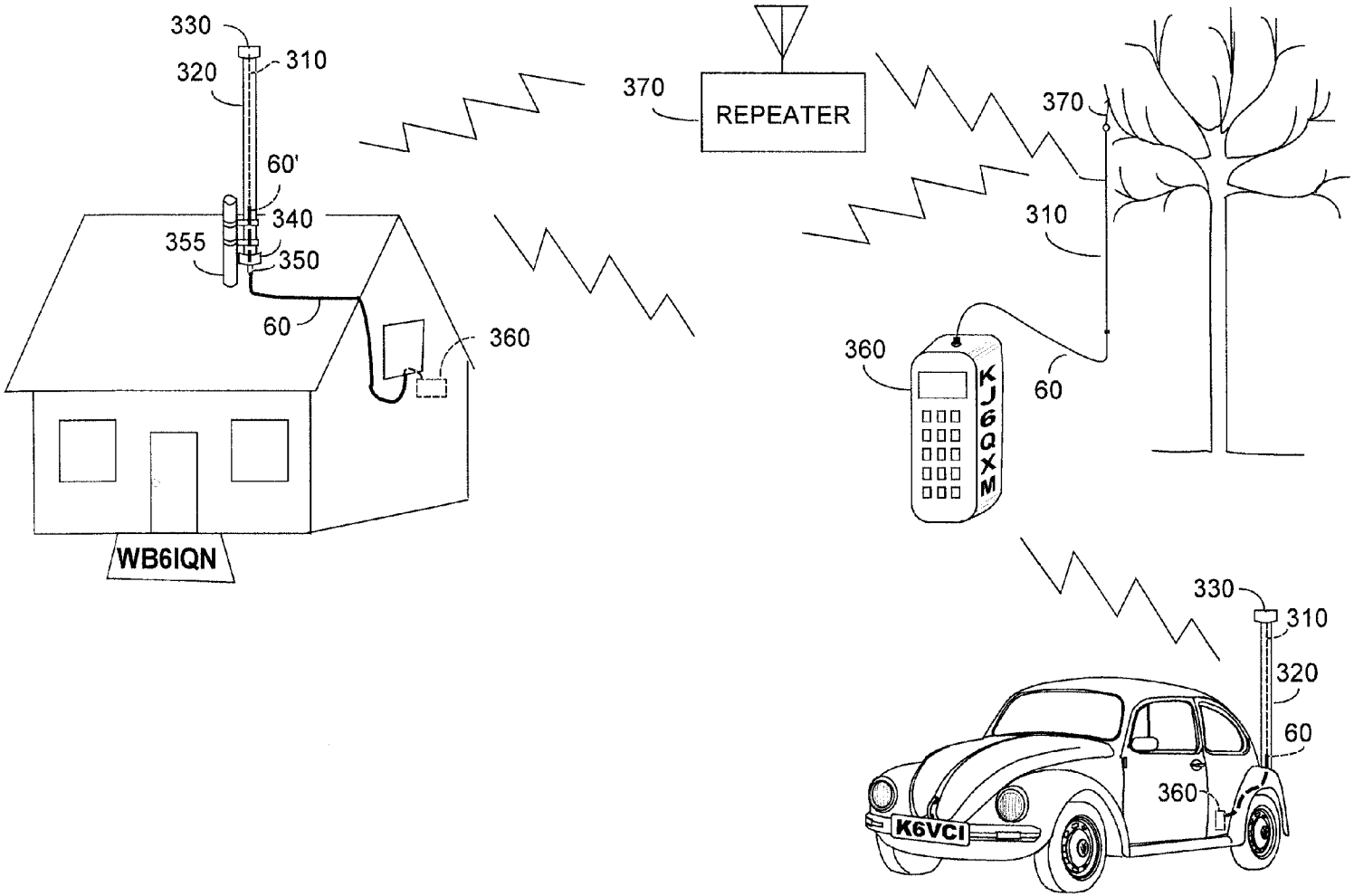
FIG. 13 depicts exemplary deployment of embodiments of the triband antenna of FIG. 11A, according to preferred embodiments of the present invention.

At the upper right portion of FIG. 13, device 360 is a low power, typically 3 W to 5 W, handheld transceiver, show coupled to triband antenna 310 via coaxial cable 60. The upper end of antenna 310 is shown connected by a string or the like 360 to an overhead branch of a tree. In an emergency situation where the user of the handheld transceiver (or handi-talkie) must make radio communication to summon help, the 6 dB to 8 dB gain provided by antenna 310 over a rubber duck antenna can make the difference between successful communications and no communications. Advantageously, as noted if triband antenna 310 is designed for use, and used, without protective PVC tubing, the antenna can literally be rolled up and stuffed in a backpack or even a pocket. In practice triband antenna 310 can safely handle RF transmitted power in the range of about 75 W over the three bands for which the antenna was designed.

At the lower right corner of FIG. 13, antenna 310 is again protected by PVC tubing 320 and is mounted at the rear of a vehicle in a mobile configuration. Coaxial cable 60 is brought into the vehicle and coupled to device 360, which is often hidden in the trunk or other out-of-sight location to minimize theft. In such installations a remote head connects electrically to device 360 and may be mounted by the driver's seat, with connection for a microphone, and with full control over the remotely located device.

To summarize, the present invention provides a triband omni-directional collinear antenna that operates without radials or an absolute ground on any or all of the VHF, intermediate band, and UHF band frequencies. The resultant antenna is inexpensive to fabricate, e.g., using 300Ω twinlead or the like, some wire, some coaxial cable, and is light weight and thus readily and inexpensively shipped. The antenna can be designed and deployed within protective PVC pipe, or can be designed and use without pipe. In the latter case, the antenna can be rolled-up and kept in a backpack, or a glove compartment for use when needed, perhaps with a VHF, UHF, or intermediate band mobile transceiver. The antenna has the gain performance of a half wavelength dipole on each band, namely 2.1 dB gain over an isotropic radiation, and provides about 6 dB to about 8 dB gain over the rubber duck type antenna found on handheld VHF-UHF-intermediate band handheld transceivers. At UHF and at VHF operation the triband antenna provides an end-fed half-wavelength vertical dipole, and at intermediate band operation the triband antenna provides a center-fed half-wavelength vertical dipole. The antenna can be adjusted or fine-tuned to affect operation on one band without interfering with the performance of the antenna on the other two bands. Depending upon presence or absence of a protective PVC tubing sheath, antenna height is about 1.6 m-1.7 m. In short, all of the design goals set out by applicant have been met by embodiments of the present invention.

While embodiments of the preferred invention have been described with respect to designing a triband antenna operable over VHF, UHF, and intermediate band frequencies, it will be appreciated that a triband antenna operating over a different selection of three bands could also be made. Further it will be appreciated that applicant's use of a helically wound half wave antenna formed over passive components of a J-pole antenna could be used even if that J-pole were a monoband antenna rather than a dual band antenna.

Modifications and variations may be made to the disclosed embodiments without departing from the subject and spirit of the invention as defined by the following claims.

What is claimed is:

1. An omni-directional triband antenna operable absent ground radials in at least one band selected from VHF band, UHF band, and intermediate VHF-UHF band, with performance of a half wavelength vertical dipole on each band, comprising:

a dual-band (VHF-UHF) J-pole antenna of length L1 formed from a first lead of wire spaced-apart and parallel to a second lead of wire, and includes:

a half wavelength vertically disposed VHF radiator;

a half wavelength vertically disposed UHF radiator; and a passive impedance transformer having length l1 of said total length L1, disposed between a bottommost region of said UHF radiator and a bottommost region of said J-pole antenna whereat said first lead and said second lead are connected together to form a 0Ω bottom end of said J-pole antenna such that a distance Δ above said 0Ω bottom end there exists a first feedpoint in said first lead and a second feedpoint in said second lead;

a length Lc of coaxial cable having a center conductor with a first end coupled to one of said first feedpoint and said second feedpoint, and having a second end defining a center conductor connection port for said triband antenna, and having a braid shield with a first end coupled to whichever of said first feedpoint and said feedpoint is unconnected to said first end of said length Lc of coaxial cable, and having a second end defining a braid shield connection port for said triband antenna;

wherein said center conductor connection port and said braid shield connection port at said second end of said length Lc of coaxial cable define an antenna connection port for said triband antenna, to which antenna connection port a device operable in at least one said band can be coupled via an external length of coaxial cable a vertically disposed half wavelength intermediate band antenna that includes:

a first helix comprising a first length of wire, having an upper end and a lower end and a quarter wavelength at said intermediate band therebetween, wrapped helically concentrically in a first direction about said passive impedance transformer section of said J-pole antenna with a helix length of Lx1<l1, said upper end of said first length of wire allowed to float, and said lower end of said first length of wire connected to one of said first feedpoint and said second feedpoint; and a second helix comprising a second length of wire, having an upper end and a lower end and a quarter wavelength at said intermediate band therebetween, wrapped helically concentrically in said first direction about an upper portion of length Lx2<Lc of said length Lc of coaxial cable, said upper end of said second wire connected to whichever one of said first feedpoint and said second feedpoint is unconnected to said first helix, and said lower end of said second wire allowed to float;

whereby a diameter of each said helix is substantially less than a wavelength at said intermediate band such that said half wave intermediate band antenna is substantially vertically disposed; and whereby cross-band interference with said J-pole antenna from said half wavelength intermediate band antenna is substantially eliminated as said first helix and said second helix are each formed about a passive region of said triband antenna.

2. The triband antenna of claim 1, wherein said triband antenna has at least one characteristic selected from a group consisting of (i) an impedance between said first feedpoint and said second feedpoint of about 50Ω, and (ii) an impedance at said antenna connection port of about 50Ω.

3. The triband antenna of claim 1, wherein at least a portion of said length L1 is twinlead comprising said lead 1 and said lead 2, said twinlead having an impedance of about 300Ω.

4. The triband antenna of claim 1, wherein said passive impedance transformer acts as a quarter wavelength at VHF and is three-quarter wavelength at UHF.

5. The triband antenna of claim 1, further including means for decoupling said UHF radiator from at least a portion of said VHF radiator.

6. The triband antenna of claim 5, wherein said means for decoupling includes a length l4 of coaxial cable having an upper end with center conductor and braid shield coupled together and to a lower end of at least a portion of said VHF radiator, and having a lower end whereat said braid shield floats and said center conductor of length l4 is connected to an upper end of said UHF radiator; wherein l4 is a quarter wavelength at said UHF band.

7. The triband antenna of claim 1, wherein with respect to each said helix, said first direction is selected from a group consisting of (i) clockwise relative to a longitudinal axis of said triband antenna, and (ii) counterclockwise clockwise relative to a longitudinal axis of said triband antenna.

8. The triband antenna of claim 1, wherein overall length of said antenna is about 64".

9. The triband antenna of claim 1, where said VHF band includes a frequency range from about 140 MHz to about 170 MHz.

10. The triband antenna of claim 1, wherein in said VHF band, SWR≤1.5 over a frequency range of about 144 MHz to about 148 MHz.

11. The triband antenna of claim 1, wherein said UHF band includes a frequency range from about 420 MHz to about 470 MHz.

12. The triband antenna of claim 1, wherein in said UHF band, SWR≤1.7 over a frequency range of about 440 MHz to about 450 MHz.

13. The triband antenna of claim 1, wherein said intermediate band includes a frequency range from about 220 MHz to about 225 MHz.

14. The triband antenna of claim 1, wherein in said intermediate band, SWR≤1.5 over a frequency range of about 220 MHz to about 225 MHz.

15. The triband antenna of claim 1, further including a protective sheath of PVC tubing sized to encase said triband antenna.

16. A triband antenna having an upper, high impedance, end and a lower end defining a low impedance antenna connection port, and operable as a half wave vertical antenna absent ground radials in at least one band selected from VHF, UHF, and intermediate VHF-UHF, comprising:

an uppermost length l5 of twinlead, whose uppermost end is said upper high impedance end of said triband antenna and whose lower end is also high impedance, said twinlead comprising a first lead spaced apart from a parallel second lead; said length l5 forming a portion of a half wave VHF radiator for said triband antenna;

means for decoupling UHF, having an upper end coupled to said second lead of said lower end of said length l5 of twinlead, and having a lower end, with a length l4 therebetween;

wherein a length of said lead 1 opposite said means for decoupling UHF defines a cut extending said length l4;

a length equal to (L1-l5-l4) of twinlead extending downward from said lower end of said means for decoupling and at a lower end defining a 0Ω region of said triband antenna;

an uppermost region of length l3 of said length equal to (L1-l5-l4) forming a quarter wavelength vertically disposed UHF radiator for said triband antenna, said second lead of said length l3 coupled to said lower end of said means for decoupling, and said first lead of said length l3 floating at each end;

wherein at VHF band operation, said length l3 operates with said length l5 and said length l4 to form a half wave vertically disposed VHF radiator of said triband;

a short length l2 of twinlead coupled to a lower end of said length l3, said second lead of said length l2 coupled to a lower end of said second lead of a bottommost region of said length l3, and said first lead of said length l2 defining a cut extending said length l2:

a passive impedance transformer having length (l1+Δ) of twinlead having an upper end coupled to a lower end of said length l2, and having a lower end defining a 0Ω region of said triband antenna, and defining a first low impedance feedpoint on said lead 1 and defining a second low impedance feedpoint in said lead 2 at a distance Δ above said 0Ω region;

a length Lc of coaxial cable having a center conductor and a braid shield, said center conductor at an upper end of said length Lc coupled to one of said first low impedance feedpoint and said second low impedance feedpoint, and said braid shield at said upper end of said length Lc coupled to which low impedance feedpoint is unconnected to said upper end of said center conductor;

wherein said center conductor connection port and said braid shield connection port at said second end of said length Lc of coaxial cable define a connection port for said triband antenna, to which antenna connection port a device operable in at least one said band can be coupled via an external length of coaxial cable, a first helix comprising a first length of wire, having an upper end and a lower end and a quarter wavelength at said intermediate band therebetween, wrapped helically concentrically in a first direction about said passive impedance transformer a helix length of Lx1<l1, said upper end of said first length of wire allowed to float, and said lower end of said first length of wire connected to one of said first low impedance feedpoint and said second low impedance feedpoint; and a second helix comprising a second length of wire, having an upper end and a lower end and a quarter wavelength at said intermediate band therebetween, wrapped helically concentrically in said first direction about an upper portion of length Lx2<Lc of said length Lc of coaxial cable, said upper end of said second wire connected to whichever one of said first low impedance feedpoint and said second low impedance feedpoint is unconnected to said first helix, and said lower end of said second wire allowed to float;

whereby a diameter of each said helix is substantially less than a wavelength at said intermediate band such that said first helix and said second helix together form a vertically disposed half wave intermediate band antenna; and whereby cross-band interference from said half wavelength intermediate band antenna is substantially eliminated as said first helix and said second helix are each formed about a passive region of said triband antenna.

17. The triband antenna of claim 16, wherein said means for decoupling is a quarter wavelength UHF stub.

18. The triband antenna of claim 16, wherein said means for decoupling includes a length l4 of coaxial cable having an upper end with center conductor and braid shield coupled together and to a lower end of at least a portion of said VHF radiator, and having a lower end whereat said braid shield floats and said center conductor of length l4 is connected to an upper end of said UHF radiator; wherein l4 is a quarter wavelength at said intermediate band.

19. The triband antenna of claim 16, wherein:

said antenna exhibits an SWR≤1.5 over a frequency range of about 144 MHz to about 148 MHz;

said antenna exhibits an SWR≤1.7 over a frequency range of about 440 MHz to about 450 MHz; and said antenna exhibits an SWR≤1.5 over a frequency range of about 220 MHz to about 225 MHz.

20. The triband antenna of claim 16, wherein said twinlead is approximately 300Ω impedance, and said antenna connection port has an impedance of about 50Ω.

* * * * *